US005358155A

United States Patent [19]

Ciesla

[11] Patent Number: 5,358,155

[45] Date of Patent: Oct. 25, 1994

[54] APPARATUS AND METHOD FOR PROVIDING A PLEATED SKIRT EFFECT TO TABLECLOTH

[76] Inventor: Ethel P. Ciesla, 4696 Chapman Pkwy., Hamburg, N.Y. 14075

[21] Appl. No.: 17,869

[22] Filed: Feb. 16, 1993

[51] Int. Cl.[5] ..... A41H 43/00; A47B 13/08

[52] U.S. Cl. ..... 223/28; 223/34; 223/35; 223/1; 108/90

[58] Field of Search ..... 223/28, 34, 35, 29, 223/37, 38, 1, 68, 6, 1.1, 1; 135/115, 116, 100, 105; 108/90

[56] References Cited

U.S. PATENT DOCUMENTS

| | | | |
|---|---|---|---|
| 2,529,940 | 11/1950 | Higley | 108/90 |
| 2,572,333 | 10/1951 | Greitzer | 108/90 |
| 2,666,559 | 1/1954 | Wexler et al. | 223/68 |
| 3,368,601 | 2/1968 | Gantent-Merz | 150/52 |
| 3,540,170 | 11/1970 | Flowers | 135/115 |
| 3,959,854 | 6/1976 | Lewis | 24/84 B |
| 4,153,097 | 5/1979 | Pettibone | 160/330 |
| 4,170,181 | 10/1979 | Glasgow | 108/50 |
| 4,708,183 | 11/1987 | Figueroa | 150/52 R |
| 4,917,278 | 4/1990 | Vertimiglia | 223/68 |
| 4,947,526 | 8/1990 | Fogelman | 24/336 |
| 5,060,712 | 10/1991 | Ehrlich | 160/330 |
| 5,240,758 | 8/1993 | Honiberg | 428/100 |

*Primary Examiner*—Clifford D. Crowder
*Assistant Examiner*—Bibhu Mohanty
*Attorney, Agent, or Firm*—Hodgson, Russ, Andrews, Woods & Goodyear

[57] ABSTRACT

An apparatus and method for providing a pleated effect to a tablecloth. A hoop having a plurality of undulating portions is positioned below the table top and above the floor such that the tablecloth is supported by the hoop with folds of the tablecloth falling between the undulating portions. In order to provide an effect of fullness, the hoop diameter is selected to be greater than the table top diameter.

19 Claims, 1 Drawing Sheet

APPARATUS AND METHOD FOR PROVIDING A PLEATED SKIRT EFFECT TO TABLECLOTH

The present invention relates generally to the application to tables of tablecloths. More particularly, the present invention relates to enhancing the appearance of a tablecloth applied to a table.

In banquet halls, department stores, restaurants, and the like having displays such as, for example, flower arrangements, it is considered desirable that the table on which such an arrangement is provided have a pleasing fullness appearance. A pleated skirt effect to the tablecloth is considered desirable for providing such an appearance.

Art disclosing the use of clips or the like for attaching tablecloths and/or skirts to tables is found in U.S. Pat. Nos. 3,368,601; 3,959,854; 4,708,183; 4,947,526; and 5,060,712. These patents do not disclose a suitable apparatus or method for providing a pleated skirt effect to an unpleated tablecloth as it hangs from a table.

It is accordingly an object of the present invention to enhance the appearance of a table by providing a pleated skirt effect to an unpleated tablecloth as it hangs from the table.

It is a further object of the present invention to provide an appearance of fullness to the tablecloth as it hangs from the table.

It is another object of the present invention to provide such an enhanced appearance easily, with minimum effort, and inexpensively.

It is yet another object of the present invention to provide such an enhanced appearance without altering the tablecloth.

In order to provide a pleated skirt effect to a tablecloth hanging from a table, in accordance with the present invention a hoop having a plurality of undulating portions thereabout is positioned below the table top and above the floor to surround the table support for receiving folds of the tablecloth between the undulating portions. In order to provide an appearance of fullness, the hoop diameter is selected to be greater than the table top diameter.

The above and other objects, features, and advantages of the present invention will be apparent in the following detailed description of the preferred embodiments thereof when read in conjunction with the accompanying drawings wherein like reference numerals denote the same or similar parts throughout the several views.

DETAILED DESCRIPTION OF THE PREFERRED EMBODIMENT

Figure 1:
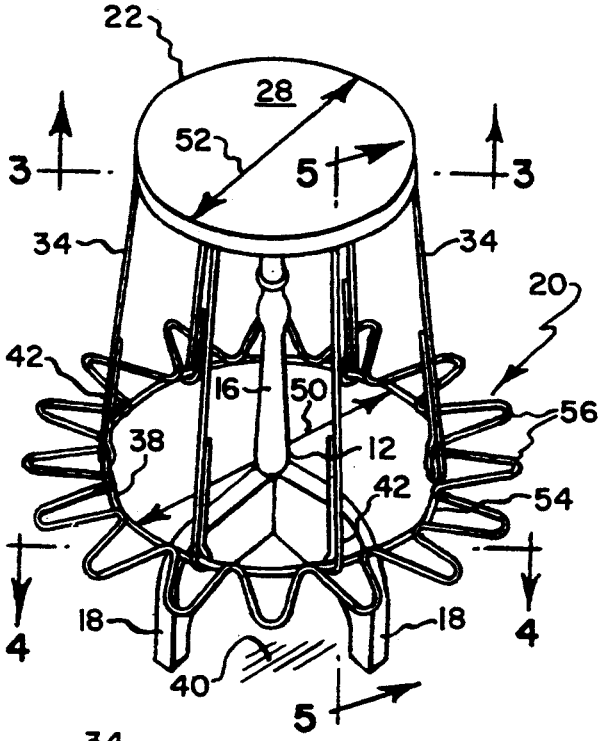
FIG. 1 is a perspective view of apparatus which embodies the present invention applied to a table.
Figure 2:
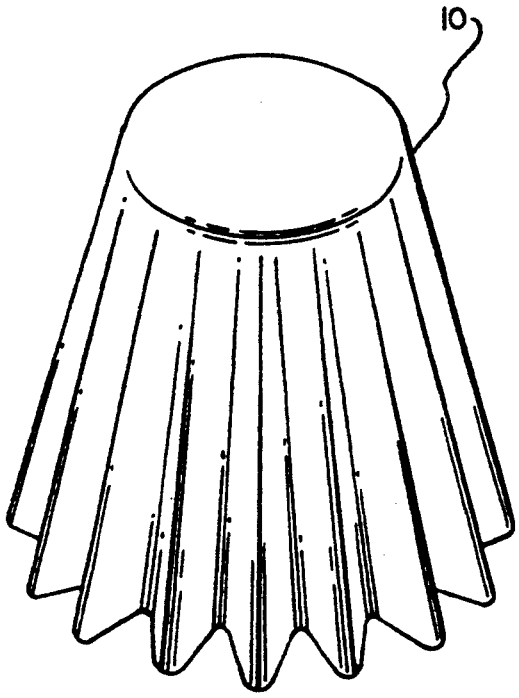
FIG. 2 is a perspective view of a tablecloth applied over the apparatus of FIG. 1.

Referring to FIG. 2, there is illustrated at 10 a tablecloth applied to the table 12 of FIG. 1. The table 12 has a round top 14 supported by a central pedestal 16 and three legs 18. It should be understood that while the present invention is illustrated herein relative to a round table, it may also be applied to other types of tables such as square in which event equivalent apparatus to that shown and described herein may be provided.

For decorative displays in department stores, banquet halls, restaurants, and the like, it is considered desirable that the hang of the tablecloth 10 have a pleasing fullness appearance. A pleasing fullness appearance may be provided by the pleated skirt effect illustrated in FIG. 2.

Figure 3:
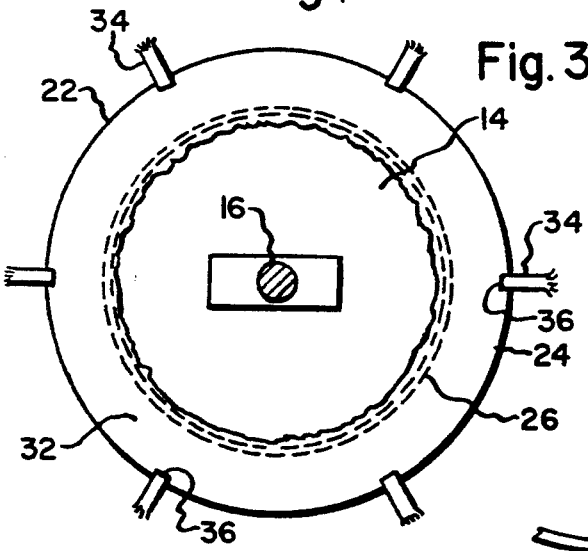
FIG. 3 is a view taken along lines 3—3 of FIG. 1.
Figure 5:
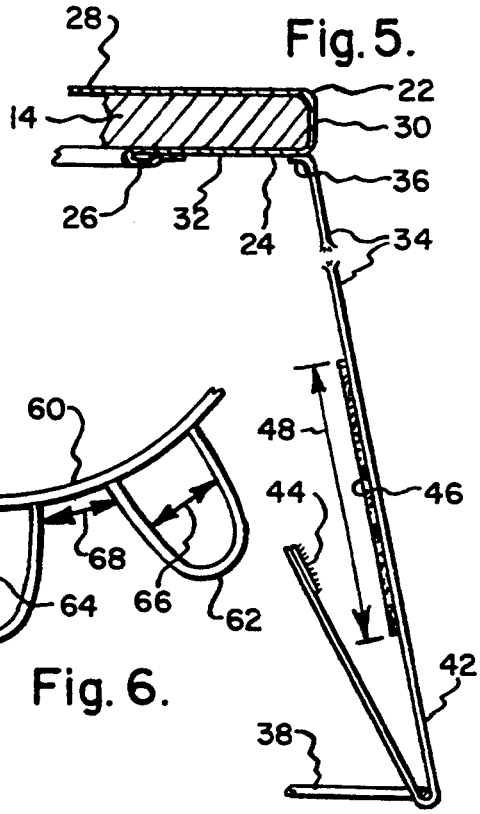
FIG. 5 is a view taken along lines 5—5 of FIG. 1.
Figure 4:
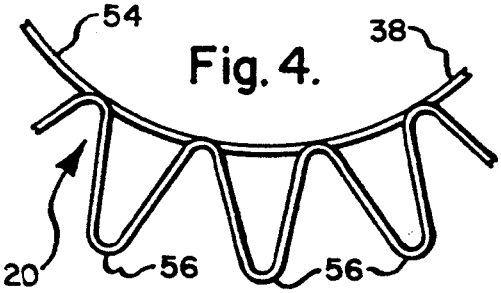
FIG. 4 is a view taken along lines 4—4 of FIG. 1.

Referring to FIG. 1, there is shown generally at 20 apparatus for providing the pleated skirt effect of FIG. 2. Apparatus 20 includes a sheet 22 having a central portion 28 sized and shaped to the size and shape of the table top to overlie the table top 14, and its peripheral edge portion 24 folds about the edge of and then under the table top and underlies the table top 14 as illustrated in FIG. 3. If desired, padding may be included with the sheet 22. The sheet 22 is held securely in position by a circular elastic member, illustrated at 26, suitably sewed into the peripheral edge of the sheet 22. As shown in FIG. 5, when applied to a table 12, the edge portion 24 includes a vertical portion 30 to overlie the table top edge and a horizontal portion 32 underlying the table top.

The sheet 22 supports a plurality of perhaps 6 downwardly hanging ribbons 34 which are suitably attached thereto such as by sewing their upper ends to the peripheral edge portion 24 preferably at the intersection of the vertical and horizontal portions 30 and 32 respectively, as illustrated at 36 in FIG. 5, so that the ribbons 34 suitably hang from the table top edge without interfering with the top surface of the table 12. The ribbons 34 are generally equally spaced about the circumference of the vertical portion 30. The ribbons 34 may, for example, be twill ribbons.

The ribbons 34 in turn support jointly a hoop 38 below the table top 14 and above the floor 40 and surrounding the pedestal 16. The lower end portions 42 of the ribbons 34 each have mating Velcro fastener members 44 and 46 spaced along the respective ribbon length for detachably attaching the ribbons 34 to the hoop 38 so that the hoop 38 is suspended from the table top 14 by the plurality of ribbons 34. The hoop 38 may, however, be suspended from the table top or otherwise positioned at a desired distance below the table top by other suitable means.

One of the Velcro members 46 may be provided with a length, illustrated at 48, and the Velcro members 44 and 46 may be spaced apart over the respective ribbon length a suitable distance allowing the ribbon end portion 42 to be looped about the hoop 38 and the Velcro member 44 to engage Velcro member 46 at any of various points so that the distance which the hoop 38 is suspended below the table top 14 may be adjusted.

The hoop 38 includes a circumferentially extending member or ring 54 to which ribbons 34 are engaged and a plurality of undulating portions 56 extending radially outwardly regularly from the ring 54 entirely thereabout to have what might be called a sine-wave shape. Folds of the tablecloth 10 are received between the undulating portions as it hangs over the hoop 38 to provide the pleasing pleated effect of FIG. 2. The ring 54 and undulating portions 56 may, for example, be formed from clothes hanger-type wire with the undulating portions 56 welded or otherwise suitably rigidly connected to the ring 54.

While the hoop 38 is shown to be circular for a round table top, the hoop 38 may have other shapes, for example square for a square table top. The diameter, illustrated at 50, of the hoop 38, which is defined herein as the diameter of the ring 54, is slightly larger than the diameter, illustrated at 52, of the table top so as to provide a fullness effect to the hanging tablecloth 10.

Figure 6:
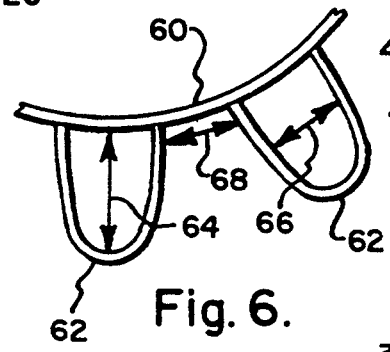
FIG. 6 is a view similar to that of FIG. 4 illustrating and alternative embodiment thereof.

Referring to FIG. 6, there is illustrated an alternative embodiment of the hoop which includes a ring 60, similar to ring 54, and circumferentially and regularly spaced projecting or undulating members 62, the folds of the tablecloth 10 falling between the projecting member 62.

For purposes of illustration and not for purposes of limitation, the following is an example of a suitable pleated effect apparatus for a 20-inch diameter pedestal round table having a height in the range of about 18 to 22 inches. The apparatus would be similar to that illustrated in the drawings with undulating portions similar to those shown in FIG. 6. Each of the ribbons 34 has a length of about 22 inches. Velcro member 44 has a length of about 1⅛ inch, Velcro member 46 has a length 48 of about 5½ inches, and the distance between the Velcro members is about 7½ inches so that the hoop 38 may be adjustably suspended at a distance between about 15 and 17 inches below the table top 14. The ring 60 has a diameter (hoop diameter) of about 22 inches. Each of the projecting members 62 extends outwardly from the ring 60 a distance, illustrated at 64, equal to about 4½ inches and has a width at 66, of about 3 inches. The hoop 38 contains 18 such projection portions 62, each pair of projecting portions being spaced apart circumferentially a distance, illustrated at 68, of perhaps about an inch.

The apparatus of the present invention is thus provided to allow a tablecloth to hang slightly outwardly in an appearance of fullness and to fall in even folds all around for a pleasing pleated skirt effect.

It should be understood that, while the invention has been described in detail herein, it can be embodied otherwise without departing from the principles of the present invention, and such other embodiments are meant to come within the scope of the present invention as defined by the appended claims.

What is claimed is:

1. Apparatus for use with a table having a table top diameter for providing a pleated effect to a tablecloth hanging from the table top comprising a hoop having a plurality of outwardly projecting portions defining an undulating pattern about said hoop for receiving folds of the tablecloth between said undulating portions for providing a pleated effect to the tablecloth and further comprising means for suspending said hoop from the table top for supporting the hanging tablecloth with folds thereof received between said projecting portions, wherein said hoop suspending means comprises a table top engaging means, a plurality of ribbons attached to said table top engaging means to be spaced about an edge of the table top, and means for detachably attaching said ribbons to said hoop, and wherein said table top engaging means has a central portion for covering the table top and a peripheral edge portion for folding about the table top edge and extending underneath the table top, said central portion having a diameter, and said hoop having a diameter which is greater than said central portion diameter.

2. Apparatus according to claim 1 wherein said hoop has a diameter which is greater than the table top diameter.

3. Apparatus for use with a table having a table top diameter for providing a pleated effect to a tablecloth hanging from the table top comprising a hoop having a plurality of outwardly projecting portions defining an undulating pattern about said hoop for receiving folds of the tablecloth between said undulating portions for providing a pleated effect to the tablecloth and further comprising means for suspending said hoop from the table top for supporting the hanging tablecloth with folds thereof received between said projecting portions, wherein said hoop suspending means comprises a table top engaging means, a plurality of ribbons attached to said table top engaging means to be spaced about an edge of the table top, and means for detachably attaching said ribbons to said hoop, and the apparatus further comprising means for adjusting the distance said hoop is suspended below the table top.

4. Apparatus according to claim 3 wherein said adjusting means comprises a hook and loop fastener having a hook fastener portion and a loop fastener portion on each of said ribbons, one of said fastener portions extending along the length of said respective ribbon a distance which allows another of said fastener portions to engage said one fastener portion at any of various points along the length of said one fastener portion.

5. Apparatus according to claim 3 wherein said hoop has a diameter which is greater than the table top diameter.

6. A method for draping a tablecloth to have a pleated effect comprising positioning below a table top and above a floor to surround a support for the table a hoop having a plurality of outwardly projecting portions defining an undulating pattern about the hoop for receiving folds of the tablecloth between the projecting portions for providing a pleated effect to the tablecloth, and placing the tablecloth on the table top to fall about the hoop with folds of the tablecloth received between the projecting portions in the pleated effect.

7. A method according to claim 6 further comprising suspending the hoop from the table top.

8. A method according to claim 7 further comprising adjusting the distance the hoop is suspended below the table top.

9. A method according to claim 6 further comprising disposing on the table top a member to which is attached a plurality of ribbons so that the ribbons are spaced about an edge of the table top and attaching the ribbons to the hoop.

10. A method according to claim 6 further comprising selecting the hoop to have a diameter greater than that of the table top.

11. Apparatus for use with a table having a table top diameter comprising a hoop which includes means for providing a pleated skirt effect to a tablecloth hanging from the table top, said pleated skirt effect means comprising means defining a pattern of undulations about said hoop for receiving folds of the tablecloth between said undulations, the apparatus further comprising means including a plurality of ribbons for suspending said hoop from the table top for supporting the hanging tablecloth with folds thereof received between the undulations.

12. Apparatus according to claim 11 wherein said hoop suspending means comprises a table top engaging means to which said ribbons are attached to be spaced about an edge of the table top and means for detachably attaching said ribbons to said hoop.

13. Apparatus according to claim 12 wherein said table top engaging means has a central portion for covering the table top and a peripheral edge portion for folding about the table top edge and extending underneath the table top, said central portion having a diameter, and said hoop having a diameter which is greater than said central portion diameter.

14. Apparatus according to claim 12 further comprising means for adjusting the distance said hoop is suspended below the table top.

15. Apparatus according to claim 14 wherein said adjusting means comprises a hook and loop fastener having a hook fastener portion and a loop fastener portion on each of said ribbons, one of said fastener portions extending along the length of one of said ribbons a distance which allows another of said fastener portions to engage said one fastener portion at any of various points along the length of said one fastener portion.

16. Apparatus according to claim 14 wherein said hoop has a diameter which is greater than the table top diameter.

17. Apparatus according to claim 11 wherein said hoop comprises a ring having a plurality of members rigidly attached thereto and extending radially outwardly regularly from the ring entirely thereabout to provide the pleated effect.

18. Apparatus according to claim 11 wherein said ribbons are composed of fabric.

19. Apparatus according to claim 11 wherein said hoop has a diameter which is greater than the table top diameter.

* * * * *